US009901796B2

(12) United States Patent
Murray

(10) Patent No.: US 9,901,796 B2
(45) Date of Patent: Feb. 27, 2018

(54) SMART PHONE HOLDING SYSTEM

(71) Applicant: Fred Murray, San Mateo, CA (US)

(72) Inventor: Fred Murray, San Mateo, CA (US)

( * ) Notice: Subject to any disclaimer, the term of this patent is extended or adjusted under 35 U.S.C. 154(b) by 3 days.

(21) Appl. No.: 15/137,652

(22) Filed: Apr. 25, 2016

(65) Prior Publication Data

US 2017/0304695 A1 Oct. 26, 2017

(51) Int. Cl.
*A63B 55/00* (2015.01)
*A45C 11/00* (2006.01)
*A45C 13/00* (2006.01)

(52) U.S. Cl.
CPC ..... *A63B 55/408* (2015.10); *A45C 11/00* (2013.01); *A45C 13/005* (2013.01); *A45C 2011/002* (2013.01)

(58) Field of Classification Search
CPC . A45C 11/00; A45C 13/005; A45C 2011/002; A63B 55/408
USPC ..... 206/315.1–315.3, 305, 320; 248/288.31, 248/309.1
See application file for complete search history.

(56) References Cited

U.S. PATENT DOCUMENTS 5,497,214 A 3/1996 Labree
D424,302 S 5/2000 Price, Jr.
6,142,437 A 11/2000 Wilkins, Jr.
7,374,144 B1 * 5/2008 Wonderling ..... A47B 97/08 248/441.1
D576,659 S 9/2008 Bevirt
7,631,763 B1 * 12/2009 Brown ..... A63B 55/408 116/173
7,712,712 B2 5/2010 Richter
2003/0132127 A1 * 7/2003 Miller ..... A45C 13/02 206/320
2004/0099295 A1 * 5/2004 You ..... A45B 11/00 135/16
2010/0252711 A1 * 10/2010 Buchner ..... E04H 12/2269 248/539
2011/0297566 A1 * 12/2011 Gallagher ..... F16M 11/105 206/320
2011/0315727 A1 12/2011 Ferraioli et al.
2013/0168275 A1 * 7/2013 Hennessey ..... G06F 1/1626 206/320
2015/0068932 A1 * 3/2015 Lee ..... A63B 55/00 206/315.3

FOREIGN PATENT DOCUMENTS

WO WO2014025184 2/2014

* cited by examiner

*Primary Examiner* — Chun Cheung

(57) ABSTRACT

A smart phone holding system for coupling a smart phone to a golf bag includes a golf bag has an upper edge. A stanchion is removably coupled to the golf bag having the stanchion extending upwardly from the golf bag. A gripping unit is movably coupled to the stanchion. The gripping unit may retain an electronic device thereby facilitating the electronic device to be observed.

7 Claims, 5 Drawing Sheets

SMART PHONE HOLDING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to holding devices and more particularly pertains to a new holding device for coupling a smart phone to a golf bag.

BRIEF SUMMARY OF THE INVENTION

An embodiment of the disclosure meets the needs presented above by generally comprising a golf bag has an upper edge. A stanchion is removably coupled to the golf bag having the stanchion extending upwardly from the golf bag. A gripping unit is movably coupled to the stanchion. The gripping unit may retain an electronic device thereby facilitating the electronic device to be observed.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
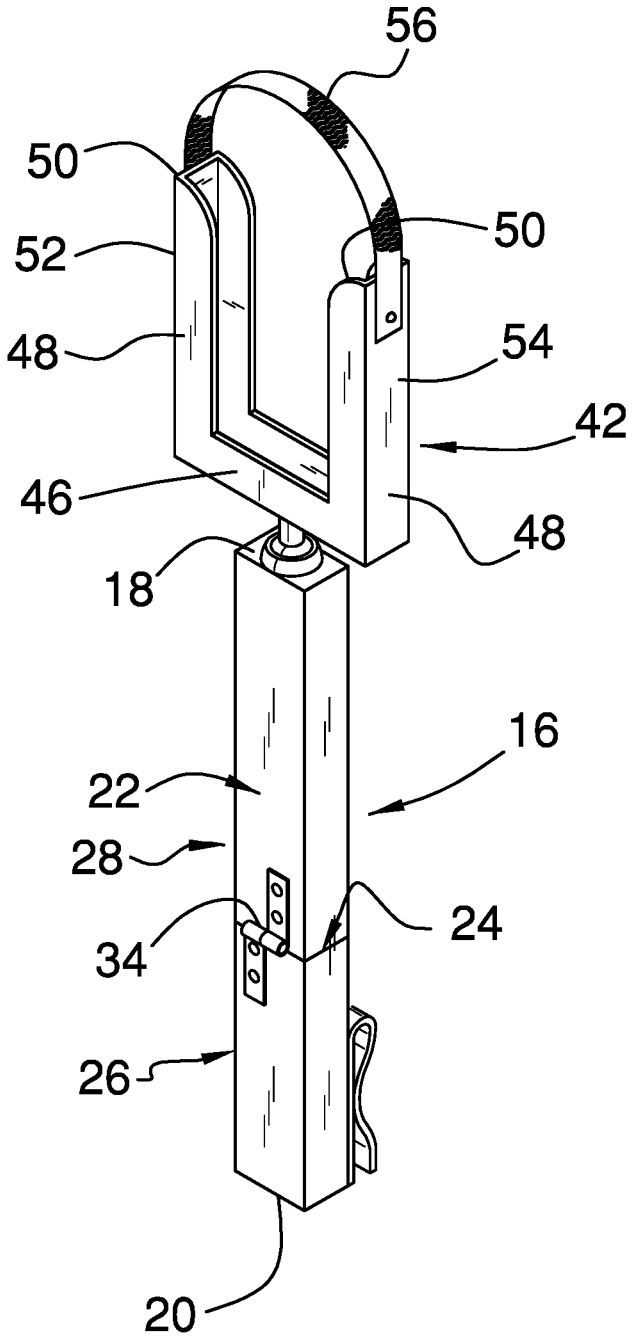
FIG. 1 is a perspective view of a smart phone holding system according to an embodiment of the disclosure.
Figure 2:
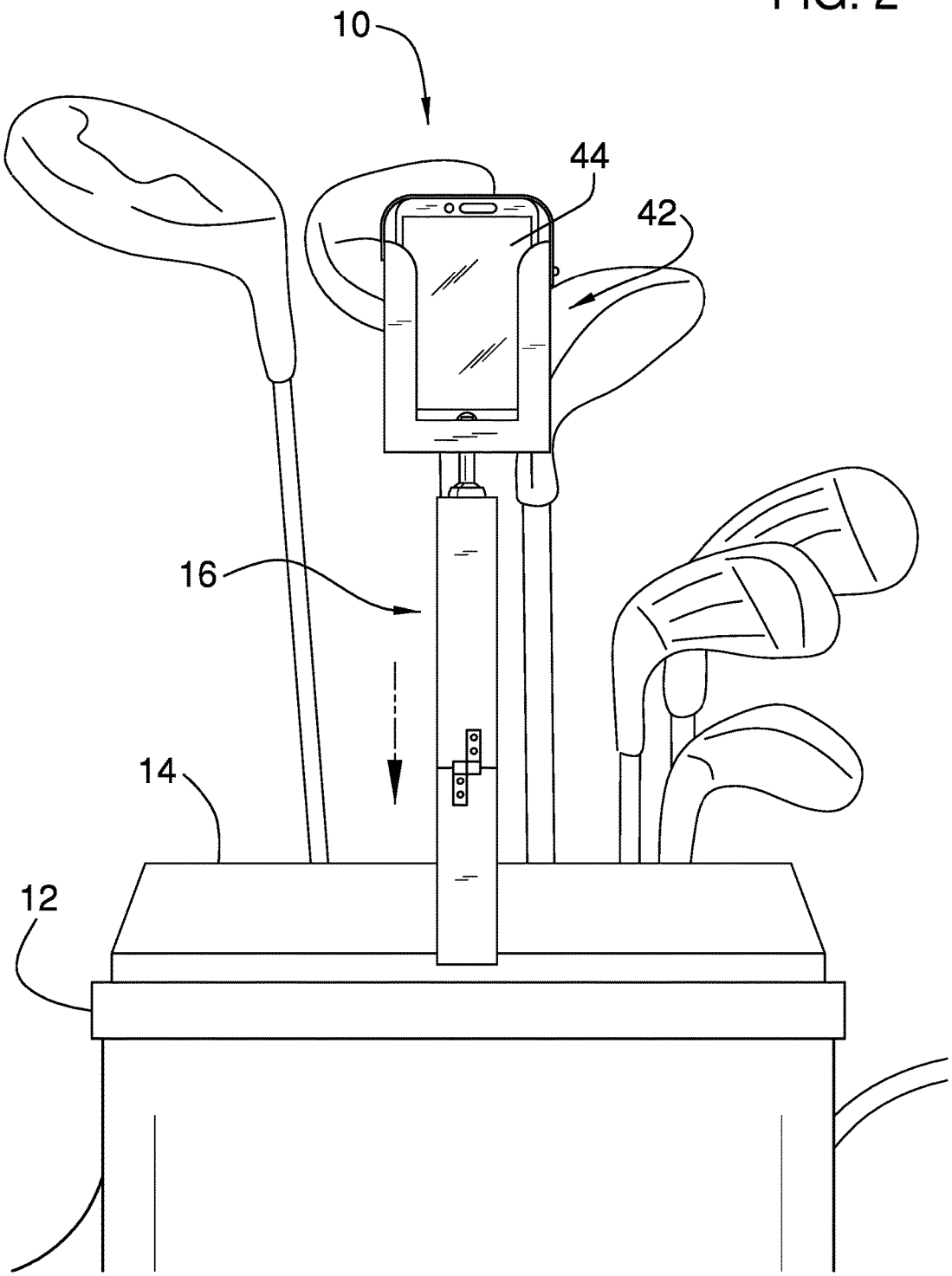
FIG. 2 is a perspective in-use view of an embodiment of the disclosure.
Figure 3:
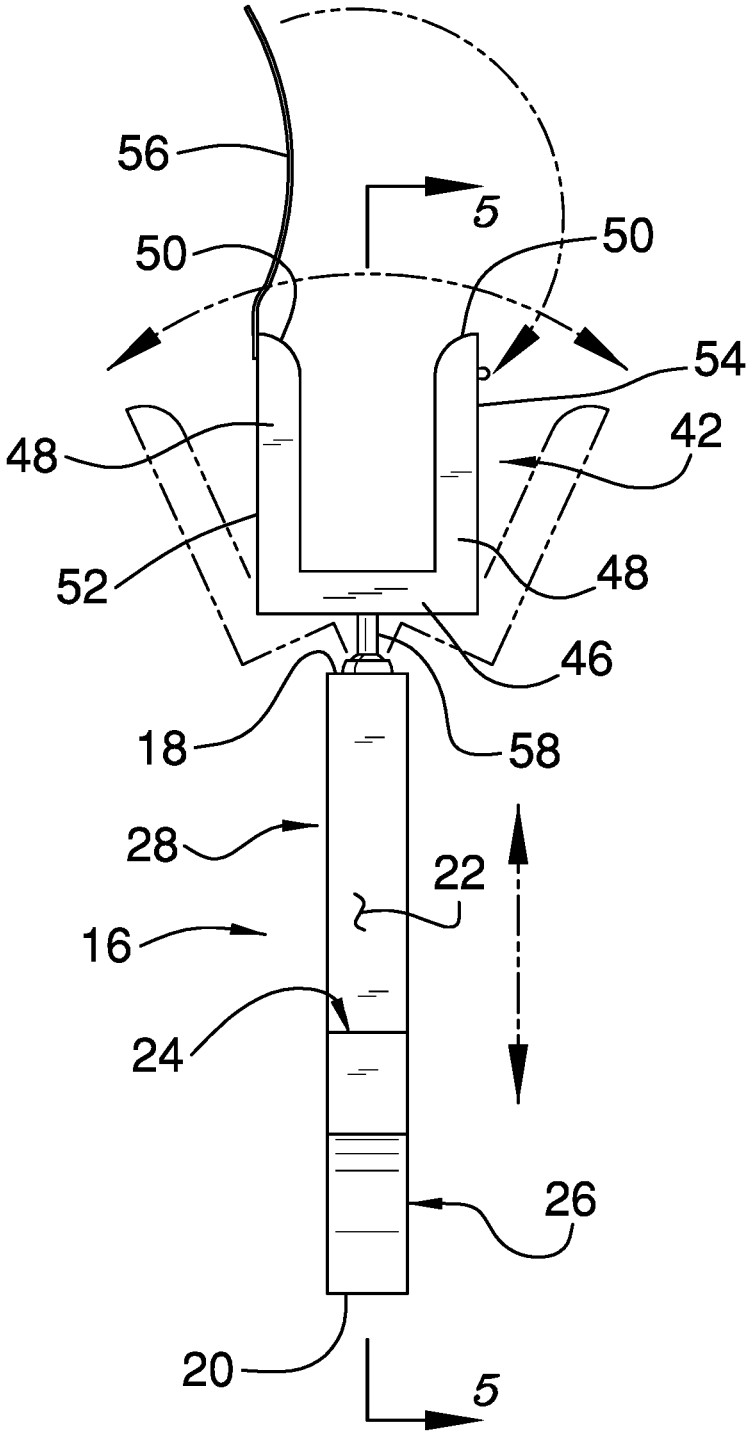
FIG. 3 is a back view of an embodiment of the disclosure.
Figure 4:
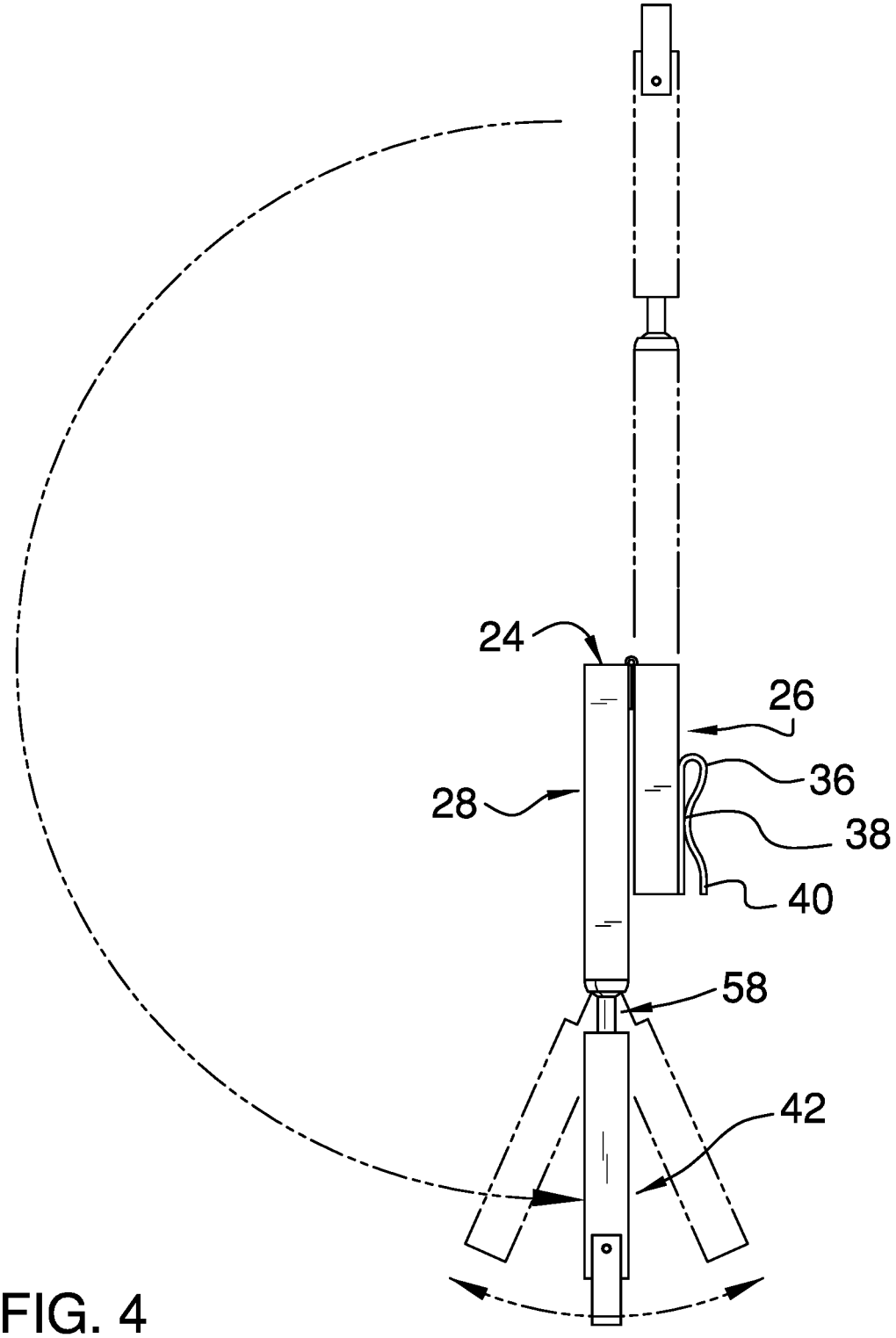
FIG. 4 is a right side view of an embodiment of the disclosure.
Figure 5:
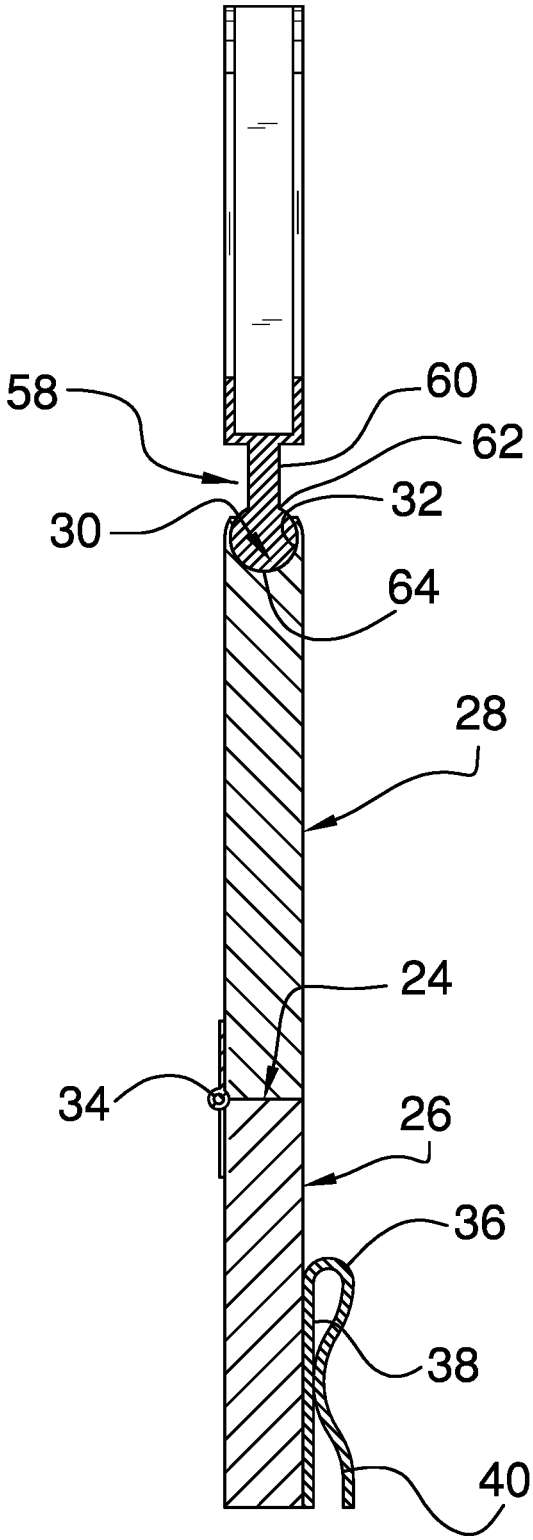
FIG. 5 is a cross sectional view taken along line 5-5 of FIG. 3 of an embodiment of the disclosure.

With reference now to the drawings, and in particular to FIGS. 1 through 5 thereof, a new holding device embodying the principles and concepts of an embodiment of the disclosure and generally designated by the reference numeral 10 will be described.

As best illustrated in FIGS. 1 through 5, the smart phone holding system 10 generally comprises a golf bag 12 that has an upper edge 14. The golf bag 12 may be a golf bag of any conventional design. A stanchion 16 is removably coupled to the golf bag 12. The stanchion 16 is positioned to extend upwardly from the golf bag 12.

The stanchion 16 has a first end 18, a second end 20 and a peripheral surface 22 extending therebetween. The stanchion 16 has a cut 24 between the first end 18 and the second end 20 to define a lower half 26 and an upper half 28 of the stanchion 16. The first end 18 has a well 30 extending toward the second end 20. The well 30 has a bounding surface 32 and the bounding surface 32 is spherically curved. The upper half 28 may comprise a telescopically adjustable rod or the like.

A hinge 34 is coupled between the lower half 26 and the upper half 28. The stanchion 16 is positioned in a folded position. Thus, the upper half 28 extends along the lower half 26. The stanchion 16 is positioned in a deployed position. Thus, the upper half 28 extends away from the lower half 26. The hinge 34 may comprise a friction hinge or the like.

A clip 36 is provided and the clip 36 has a first member 38 that is spaced from a second member 40. The first member 38 is coupled to the peripheral surface 22 corresponding to the lower half 26. The first member 38 is biased toward the second member 40. The clip 36 selectively engages the upper edge 14 of the golf bag 12 such that the stanchion 16 is retained on the golf bag 12. The upper edge 14 of the golf bag 12 may be inserted between the first member 38 and the second member 40.

A gripping unit 42 is movably coupled to the stanchion 16. The gripping unit 42 may retain an electronic device 44 in an exposed position with respect to the golf bag 12. Thus, the electronic device 44 may be observed when the gripping unit 42 is coupled to the stanchion 16. The electronic device 44 may be a smart phone or the like.

The gripping unit 42 comprises a central channel 46 extending between a pair of upright channels 48. The upright channels 48 are spaced apart from each other. Each of the central channel 46 and the upright channels 48 may slidably receive the electronic device 44. Each of the pair of upright channels 48 has a distal end 50 with respect to the central channel 46. The pair of upright channels 48 includes a first channel 52 and a second channel 54.

A strap 56 is provided and the strap 56 is coupled to the first channel 52. Thus, the strap 56 may be manipulated. The strap 56 is positioned adjacent to the distal end 50 corresponding to the first channel 52. The strap 56 selectively engages the second channel 54 such that the strap 56 is coupled between the pair of upright channels 48. Thus, the strap 56 may retain the electronic device 44 in the gripping unit 42. The strap 56 may extend over a top side of the electronic device 44 when the strap 56 engages the second channel 54. The strap 56 may be comprised of a resiliently stretchable material such as elastic or the like.

A mount 58 is coupled to and extends away from the central channel 46. Moreover, the mount 58 extends in an opposite direction with respect to the upright channels 48. The mount 58 rotatably engages the stanchion 16. Thus, the gripping unit 42 is rotatably retained on the stanchion 16.

The mount 58 comprises a stem 60 that is coupled to and extends away from the central channel 46. The stem 60 has a distal end 62 with respect to the central channel 46. The stem 60 is centrally positioned on the central channel 46. A ball 64 is coupled to the distal end 62 of the stem 60. The ball 64 is positioned in the well 30 such that the ball 64 is selectively rotatable in the well 30. Thus, the mount 58 facilitates the electronic device 44 to be retained at a selected orientation with respect to the stanchion 16.

In use, the clip 36 is manipulated to engage the upper edge 14 of the golf bag 12. The golf bag 12 is employed while playing golf. The electronic device 44 is positioned in the gripping unit 42. The strap 56 is manipulated to retain the electronic device 44 in the gripping unit 42. The stanchion 16 is selectively positioned in the folded position and the deployed position.

The gripping unit 42 is manipulated to position the electronic device 44 at a selected orientation with respect to the golf bag 12. Thus, the electronic device 44 is visible with playing golf. The electronic device 44 is manipulated to record a golf swing while playing golf. Thus, a user is facilitated to record the user's golf swing without assistance from a person.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A smart phone holding system comprising:

a golf bag having an upper edge;

a stanchion being removably coupled to said golf bag having said stanchion extending upwardly from said golf bag; and a gripping unit being movably coupled to said stanchion, said gripping unit being configured to retain an electronic device thereby facilitating the electronic device to be observed, said gripping unit having a central channel extending between a pair of upright channels, said upright channels being spaced apart from each other, each of said central channel and said upright channels being configured to slidably receive the electronic device, each of said pair of upright channels having a distal end with respect to said central channel, said pair of upright channels including a first channel and a second channel; and a strap being coupled to said first channel wherein said strap is configured to be manipulated, said strap being positioned adjacent to said distal end corresponding to said first channel, said strap selectively engaging said second channel such that said strap is coupled between said pair of upright channels wherein said strap is configured to retain the electronic device in said gripping unit.

2. The assembly according to claim 1, wherein said stanchion has a first end, a second end and a peripheral surface extending therebetween, said stanchion having a cut between said first end and said second end to define a lower half and an upper half of said stanchion, said first end having a well extending toward said second end, said well having a bounding surface, said bounding surface being spherically curved.

3. The assembly according to claim 2, further comprising a hinge being coupled between said lower half and said upper half, said stanchion being positioned in a folded position having said upper half extending along said lower half, said stanchion being positioned in a deployed position having said upper half extending away from said lower half.

4. The assembly according to claim 3, further comprising a clip having a first member being spaced from a second member, said first member being coupled to said peripheral surface corresponding to said lower half, said clip selectively engaging said upper edge of said golf bag such that said stanchion is retained on said golf bag.

5. A smart phone holding system comprising:

a golf bag having an upper edge;

a stanchion being removably coupled to said golf bag having said stanchion extending upwardly from said golf bag; and a gripping unit being movably coupled to said stanchion, said gripping unit being configured to retain an electronic device thereby facilitating the electronic device to be observed, said gripping unit having a central channel extending between a pair of upright channels, said upright channels being spaced apart from each other, each of said central channel and said upright channels being configured to slidably receive the electronic device, each of said pair of upright channels having a distal end with respect to said central channel, said pair of upright channels including a first channel and a second channel; and a mount being coupled to and extending away from said central channel in an opposite direction with respect to said upright channels, said mount rotatably engaging said stanchion such that said gripping unit is rotatably retained on said stanchion.

6. The assembly according to claim 5, wherein:

said stanchion has a well; and said mount comprises:

a stem being coupled to and extending away from said central channel, said stem having a distal end with respect to said central channel, and a ball being coupled to said distal end of said stem, said ball being positioned in said well such that said ball is selectively rotatable in said well wherein said mount is configured to facilitate the electronic device to be retained at a selected orientation with respect to said stanchion.

7. A smart phone holding system comprising:

a golf bag having an upper edge;

a stanchion being removably coupled to said golf bag having said stanchion extending upwardly from said golf bag, said stanchion comprising:

a first end, a second end and a peripheral surface extending therebetween, said stanchion having a cut between said first end and said second end to define a lower half and an upper half of said stanchion, said first end having a well extending toward said second end, said well having a bounding surface, said bounding surface being spherically curved, a hinge being coupled between said lower half and said upper half, said stanchion being positioned in a folded position having said upper half extending along said lower half, said stanchion being positioned in a deployed position having said upper half extending away from said lower half, a clip having a first member being spaced from a second member, said first member being coupled to said peripheral surface corresponding to said lower half, said clip selectively engaging said upper edge of said golf bag such that said stanchion is retained on said golf bag; and a gripping unit being movably coupled to said stanchion, said gripping unit being configured to retain an electronic device thereby facilitating the electronic device to be observed, said gripping unit comprising:

a central channel extending between a pair of upright channels, said upright channels being spaced apart from each other, each of said central channel and said upright channels being configured to slidably receive the electronic device, each of said pair of upright channels having a distal end with respect to said central channel, said pair of upright channels including a first channel and a second channel, a strap being coupled to said first channel wherein said strap is configured to be manipulated, said strap being positioned adjacent to said distal end corresponding to said first channel, said strap selectively engaging said second channel such that said strap is coupled between said pair of upright channels wherein said strap is configured to retain the electronic device in said gripping unit, a mount being coupled to and extending away from said central channel in an opposite direction with respect to said upright channels, said mount rotatably engaging said stanchion such that said gripping unit is rotatably retained on said stanchion, said mount comprising:

a stem being coupled to and extending away from said central channel, said stem having a distal end with respect to said central channel, said stem being centrally positioned on said central channel, and a ball being coupled to said distal end of said stem, said ball being positioned in said well such that said ball is selectively rotatable in said well wherein said mount is configured to facilitate the electronic device to be retained at a selected orientation with respect to said stanchion.

* * * * *